US009297231B2

(12) United States Patent
Smith

(10) Patent No.: US 9,297,231 B2
(45) **Date of Patent: *Mar. 29, 2016**

(54) LAUNCHING TOOL WITH INTERLOCK SYSTEM FOR DOWNHOLE CEMENT PLUG AND METHOD

(75) Inventor: Sidney K. Smith, Conroe, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/221,046

(22) Filed: Aug. 30, 2011

(65) Prior Publication Data

US 2011/0308805 A1 Dec. 22, 2011

Related U.S. Application Data

(63) Continuation of application No. 12/505,952, filed on Jul. 20, 2009, now Pat. No. 8,360,141.

(60) Provisional application No. 61/082,631, filed on Jul. 22, 2008.

(51) Int. Cl.
*E21B 33/08* (2006.01)
*E21B 33/16* (2006.01)

(52) U.S. Cl.
CPC ..... *E21B 33/16* (2013.01)

(58) Field of Classification Search
USPC ..... 166/177.3, 177.4, 285, 290, 386, 318, 166/383
See application file for complete search history.

(56) References Cited

U.S. PATENT DOCUMENTS

| | | | | |
|---|---|---|---|---|
| 3,205,948 | A | 9/1965 | Preston, Jr. | |
| 4,114,694 | A | 9/1978 | Dinning | |
| 6,082,451 | A | 7/2000 | Giroux et al. | |
| 6,527,057 | B2 | 3/2003 | Fraser, III et al. | |
| 2002/0104656 | A1 | 8/2002 | Murley et al. | |
| 2003/0164237 | A1 | 9/2003 | Butterfield, Jr. | |
| 2007/0102159 | A1 * | 5/2007 | Szarka | 166/291 |

OTHER PUBLICATIONS

Greg Sarber, et al., The Side Exhaust Liner Running Tool: A Tool for Liner Running and Cementing Using E-Line Coiled Tubing, SPE 120992, presentation at the 2009 SPE CoTA Coiled Tubing and Well Intervention Conference, The Woodlands, Texas, USA, Mar. 31-Apr. 1, 2009, pp. 1-13.

Seung Kook Lee, et al., Lessons Learned from Highly Deviated Openhole Completions in Two HP/HT Retrograde Gas-Condensated Fields Using Expandable Liner Hanger, External-Sleeve Inflatable Packer Collars, and Swellable Packers for Zonal Isolation, IADC/SPE 114789, presentation at the IADC/SPE Asia Pacific Drilling Technology Conference, Jakarta, Indonesia, Aug. 25-27, 2008, pp. 1-19.

* cited by examiner

*Primary Examiner* — David Bagnell
*Assistant Examiner* — Ronald Runyan
(74) *Attorney, Agent, or Firm* — Cantor Colburn LLP

(57) ABSTRACT

A wiper plug launching tool and a method of wiping a tubular after cementing, the wiper plug launching tool including a wiper plug; a retainer in operable communication with the wiper plug; and an interlock system operatively arranged for releasing the retainer only upon release of the interlock system.

11 Claims, 4 Drawing Sheets

LAUNCHING TOOL WITH INTERLOCK SYSTEM FOR DOWNHOLE CEMENT PLUG AND METHOD

CROSS-REFERENCE TO RELATED APPLICATIONS

This is a continuation application of U.S. patent application Ser. No. 12/505,952, filed Jul. 20, 2009 (also published as United States Patent Publication No. 2010/0018713), which claims the benefit of an earlier filing date from U.S. Provisional Application Ser. No. 61/082,631 filed Jul. 22, 2008, the entire disclosures of which are incorporated herein by reference.

BACKGROUND

Cementing is common in the downhole industry in conjunction with the installation of a liner, etc. Often where cementing is undertaken, a wiper plug is deployed following the application of cement to wipe interior surfaces of conducting pathways, such as the inside surface of a liner to avoid the curing of any significant amount of cement on surfaces not intended to have such cement. Several configuration of launching tools are available to the art for deploying wiper plugs all of which are competent for their intended purposes. The art however is always receptive to improvements or alternative means, methods and configurations. Therefore the art will well receive the launching tool described herein.

SUMMARY

A wiper plug launching tool including a wiper plug; a retainer in operable communication with the wiper plug; and an interlock system operatively arranged for releasing the retainer only upon release of the interlock system.

A method for wiping a tubular after cementing includes running a wiper plug launching tool to a selected location; pumping cement through the wiper plug; running an actuation plug; landing the actuation plug in the launching tool; releasing an interlock system of the wiper plug launching tool resulting in release of the wiper plug; landing the actuation plug in the wiper plug; and pumping the wiper plug downhole.

BRIEF DESCRIPTION OF THE DRAWINGS

Referring now to the drawings wherein like elements are numbered alike in the several Figures.

DETAILED DESCRIPTION

Figure 1:
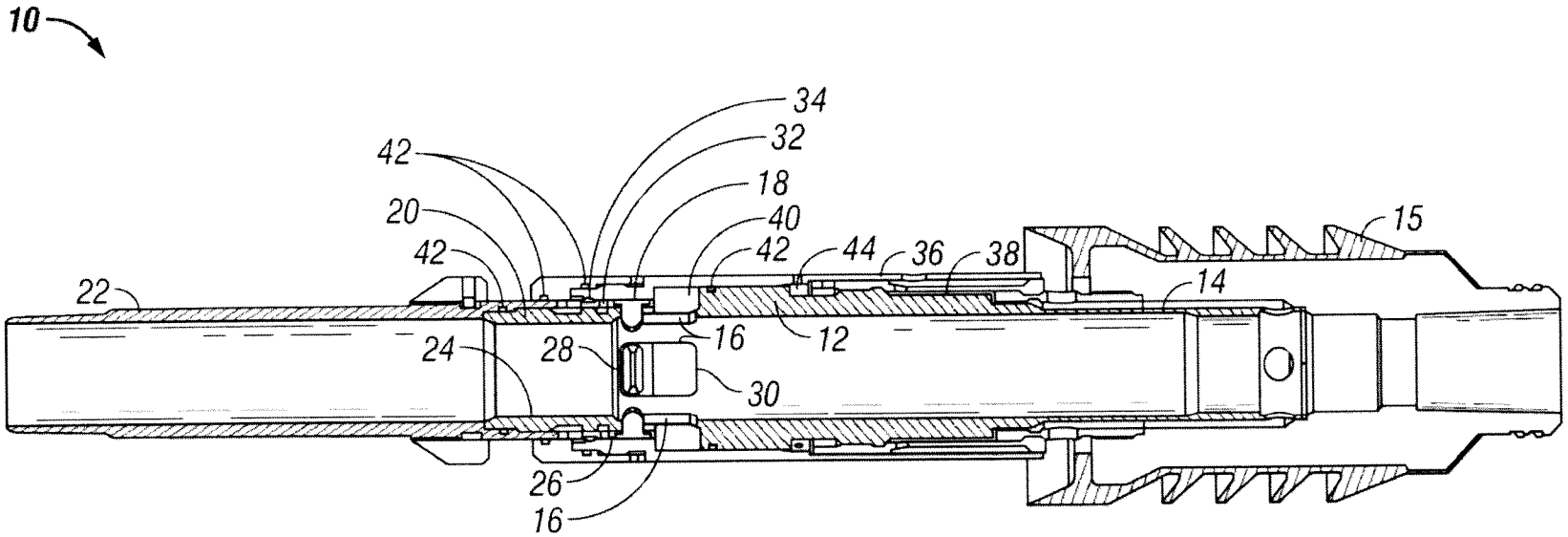
FIG. 1 is a cross section view of a launching tool as disclosed herein in a run in position.

Referring to FIG. 1, a launching tool 10 with an interlock system for a cement plug is illustrated in a run in position. The tool 10 employs a wiper mandrel 12 that includes a wiper plug engagement section 14 that provides lateral support of a wiper plug 15 for deployment. The mandrel 12 further includes a plurality of windows 16 therein that are positioned and dimensioned to accept through extension and axial displacement of one or more support dogs 18. Wiper mandrel 12 further includes an interconnection section 20 whereat the wiper mandrel 12 is fixedly connected to a gauge ring mandrel 22. Interconnection is effected by a thread 24, in one embodiment.

Figure 3:
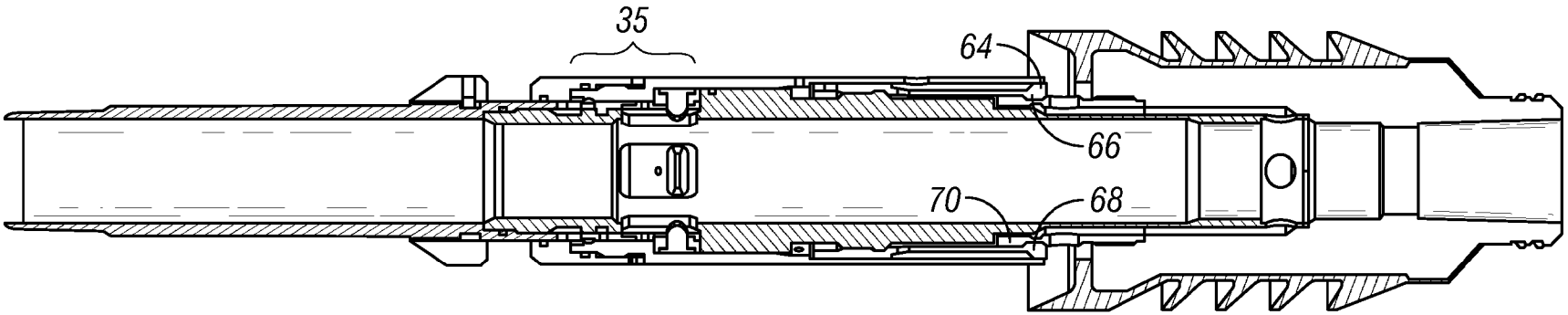
FIG. 3 is a cross section view of the tool as illustrated in FIG. 1 in a lockout released position.

Radially outwardly disposed about the wiper mandrel 12 is a release member 26 in the form, in this embodiment, of a shear ring. The shear ring 26 is axially movable on the wiper mandrel 12 sufficiently to shift the one or more dogs 18 from one end 28 to an opposite end 30 of each of the windows 16. This movement can only be accomplished however after the release of a release component 32, such as a shear screw, etc. Further, the release member 26 supports a snap ring 34 in a radially more outward position than it would naturally take to axially lock a collet retention sleeve 36, preventing movement thereof until certain other preconditions within the tool 10 exist (described hereunder). The sleeve 36 restrains a retainer such as a collet 38 from opening until the same preconditions are met. The preconditions are those that cause an interlock system 35 (see FIG. 3 for unobstructed identification) made up of the dogs 18, the release member 26, the release component 32 (both threshold release devices, meaning that a threshold level of strain or pressure, for example must be attained before release occurs) and the snap ring 34, in this embodiment, to be removed as an impediment to the movement of the other components of the tool 10.

It is to be appreciated that radially outwardly of the windows 16 is an open volume 40 that serves two purposes for the disclosed tool 10. The first purpose is to provide room for the one or more dogs 18 to move radially outwardly thereby removing an occlusion of the bore of wiper mandrel 12 (explained further hereunder) and the second purpose is to act as a piston chamber. Promoting the second purpose are o-rings (or other sealing arrangement) 42 that contain fluid thereby allowing pressure buildup in the volumes 40 for hydraulic purpose.

Finally it is noted that an additional release configuration 44 (another threshold release device) releasably attaches the sleeve 36 to the mandrel 12. In one embodiment, the configuration 44 is one or more shear screws.

Figure 2:
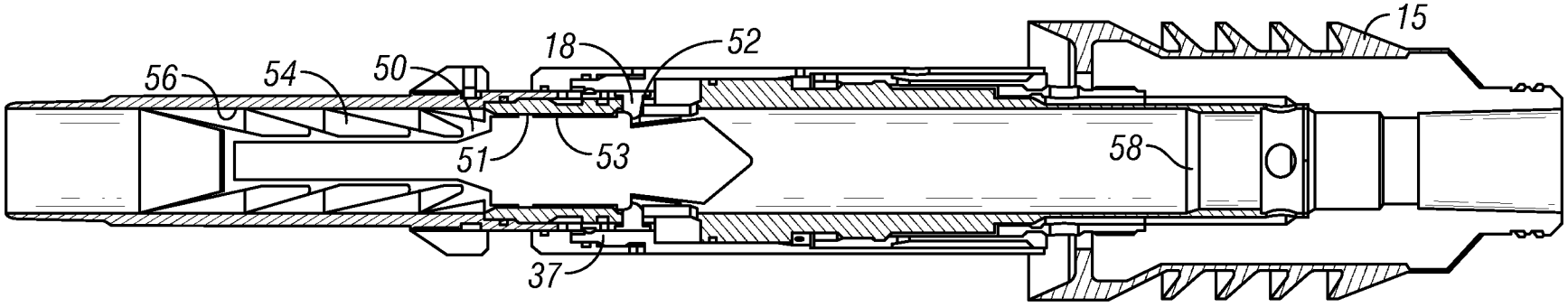
FIG. 2 is a cross section view of the tool illustrated in FIG. 1 with an actuation plug disposed therein.
Figure 4:
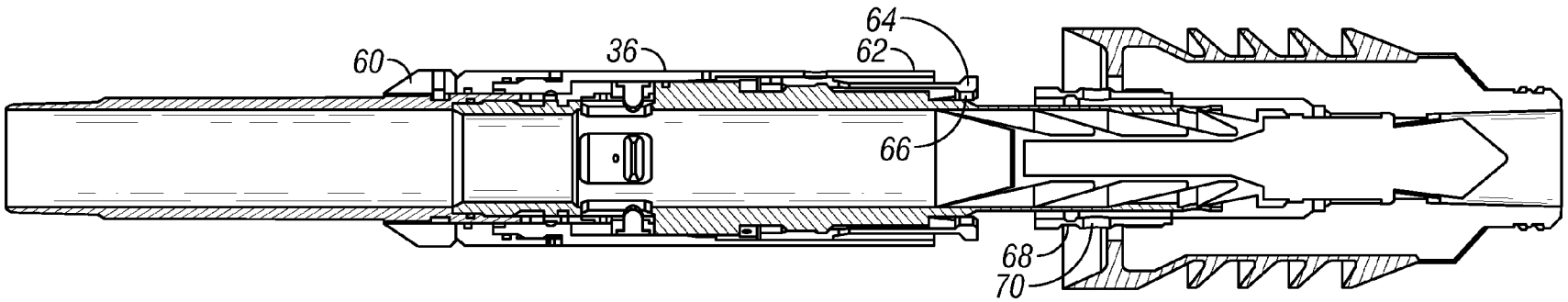
FIG. 4 is a cross sectional view of the tool as illustrated in FIG. 1 in a fully actuated position.

In operation the tool 10 as introduced above is attached to a string (not shown) and run into a borehole where its function is desired. The tool 10 is run to a selected depth and then an actuation plug 50 (see FIG. 2) is propagated to the tool 10. The actuation plug 50 lands within the interconnection section 20 with a leading profile 52 becoming supported by the one or more dogs 18. The plug 50 includes a number of seal cups 54 that contact and seal against an inside surface 56 of the gauge ring mandrel 22 to wipe cement. Further downhole on the plug 50 is one or more seals 51 that seal on an inside surface 53 (see FIG. 2) of the interconnection section 20. This allows an operator to increase pressure uphole of the plug 50 and force it to move the dogs 18, and thereby the release member 26 downhole. This will release the release component 32 and allow the dogs 18 to be moved into alignment with the open volume 40 simultaneously with the movement of the release member 26, the snap ring 34 will move radially inwardly under its own impetus once the support thereof in the radially outward position is removed (the axial motion of the release member). In another embodiment the snap ring does not have to move on its own impetus. In such embodiment, the snap ring 34 is forced down in to a radially smaller position by movement of the sleeve 36 based upon a chamfered edge 37. The dogs 18 will then move into the volume 40 with the urging of the plug 50 moving downhole. Once the dogs are fully moved into the volume 40, the plug can be hydraulically pushed past the dogs 18 and into sealing relationship with an inside dimension restriction 58 of the wiper mandrel 12. Pressure applied to the plug 50 will then increase the hydraulic load on release configuration 44 due to the fluid acting through the windows 16 into the open volume 40. A review of the drawings and the seals 42 will make clear to one of skill in the art the piston action created. Once the mechanical load on the release configuration 44 reaches a threshold value, the configuration 44 will release allowing the retention sleeve 36 to move into the position illustrated in FIG. 4. It will be appreciated that the sleeve 36 has moved in the uphole direction until making contact with a gauge ring 60 leaving a downhole end 62 of the sleeve 36 uphole of a number of finger ends 64 of the collet 38 free to deflect radially outwardly. The radially outward deflection of the finger ends 64 disengages a number of finger profiles 66 from a groove 68 in a wiper plug tail 70. A comparison of FIGS. 3 and 4 in this location will be edifying. Once the collet 38 releases from the tail 70, both the actuation plug 50 and the wiper plug 15 are free to move together under hydraulic pressure as desired.

The tool as described eliminates possible pressure spike based unintended wiper plug release as the wiper plug release cannot be completed until the interlock system has released. Since the interlock system provides a mechanical lockout, pressure even higher than that required to release prior art wiper plugs will have no effect until the interlock is first released by the actuation plug and discussed sequence.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A wiper plug launching tool comprising:

a wiper plug;

a retainer in operable communication with the wiper plug; and an interlock system operatively arranged for releasing the retainer only upon release of the interlock system, the interlock system preventing release of the retainer regardless of a fluid pressure force exerted on the interlock system or the retainer.

2. A wiper plug launching tool as claimed in claim 1 wherein the retainer is a collet.

3. A wiper plug launching tool as claimed in claim 1 wherein the release of the interlock system includes displacing a sleeve from the retainer to allow release of the retainer.

4. A wiper plug launching tool as claimed in claim 1 wherein the release of the interlock system includes displacement of one or more dogs radially.

5. A wiper plug launching tool as claimed in claim 1 wherein the release of the interlock system includes displacement of one or more dogs axially.

6. A wiper plug launching tool as claimed in claim 1 wherein the release of the interlock system includes one or more release devices that are threshold release devices.

7. A wiper plug launching tool as claimed in claim 1 wherein the tool is receptive to an actuation plug.

8. A wiper plug launching tool as claimed in claim 7 wherein the actuation plug sets in motion the release of the interlock system.

9. A method for wiping a tubular after cementing comprising:

running a wiper plug launching tool to a selected location;

pumping cement through the wiper plug;

running an actuation plug;

landing the actuation plug in the launching tool;

releasing an interlock system of the wiper plug launching tool enabling release of a retainer of the wiper plug, the interlock system preventing release of the retainer regardless of a fluid pressure force exerted on the interlock device-system or the retainer;

landing the actuation plug in the wiper plug; and pumping the wiper plug downhole.

10. A method as claimed in claim 9 wherein the release of the interlock system includes mechanical events.

11. A method as claimed in claim 9 wherein the release of the interlock system includes hydraulic events.

* * * * *